US005515149A

United States Patent [19]

Ishikawa et al.

[11] Patent Number: 5,515,149

[45] Date of Patent: May 7, 1996

[54] SHEET FEED MECHANISM WITH SPEED FEEDERS

[75] Inventors: Yutaka Ishikawa; Tomoyuki Nishikawa, both of Tokyo, Japan

[73] Assignee: Asahi Kogaku Kogyo Kabushiki Kaisha, Tokyo, Japan

[21] Appl. No.: 175,230

[22] Filed: Dec. 29, 1993

[30] Foreign Application Priority Data

Dec. 29, 1992 [JP] Japan ..... 4-093808 U
Dec. 29, 1992 [JP] Japan ..... 4-093809 U

[51] Int. Cl.[6] ..... G03G 15/00

[52] U.S. Cl. ..... 355/308; 226/74; 271/9.1; 355/316

[58] Field of Search ..... 355/308, 311, 355/309, 288, 271, 310, 316, 317, 274; 271/9, 261; 225/99; 226/74, 75, 76, 87; 400/606, 605

[56] References Cited

U.S. PATENT DOCUMENTS

| | | | |
|---|---|---|---|
| 4,890,140 | 12/1989 | Negoro et al. | 355/290 |
| 4,891,677 | 1/1990 | Shiozawa et al. | 355/280 |
| 4,987,448 | 1/1991 | Chikama | 355/205 |
| 4,989,771 | 2/1991 | Ferguson | 226/74 |
| 5,018,887 | 5/1991 | McCray et al. | 400/616.1 |
| 5,061,967 | 10/1991 | Isobe | 355/310 |
| 5,065,196 | 11/1991 | Kanaya et al. | 355/308 |
| 5,080,514 | 1/1992 | Inoue | 400/616.1 |
| 5,156,476 | 10/1992 | Ishihara et al. | 400/616.2 |
| 5,259,543 | 11/1993 | Downing | 225/99 |

FOREIGN PATENT DOCUMENTS

| | | | |
|---|---|---|---|
| 0138669 | 8/1982 | Japan | 355/274 |

*Primary Examiner*—A. T. Grimley
*Assistant Examiner*—Thu A. Dang
*Attorney, Agent, or Firm*—Greenblum & Bernstein

[57] ABSTRACT

A sheet feed mechanism utilizing a continuous form sheet, with a plurality of equally spaced sprocket holes formed on both side edges thereof in the direction along a straight sheet feed path, is fed between a photoconductive member and transfer member. Each side of the sheet feed mechanism includes an endless tractor belt looped between two feed rollers disposed upstream and downstream of the transfer member, respectively. In one aspect, engaging pins are provided on the circumferential surface of the feed rollers and engaging holes on the tractor belt spaced at the same interval as the holes of the continuous form sheet, to feed the sheet by engagement of the engaging pins and the sprocket holes through the engaging holes. In another aspect, the endless belt is provided with the engaging pins and a regulation member for moving the tractor belt such that a portion of its upper part is separated from the photoconductive member.

30 Claims, 7 Drawing Sheets

SHEET FEED MECHANISM WITH SPEED FEEDERS

FIELD OF THE INVENTION

The present invention relates to a sheet feed mechanism which can be employed in an electrophotographic printer wherein a toner image electrophotographically formed on a photoconductive member is transferred to a recording sheet.

BACKGROUND OF THE INVENTION

There have been proposed and employed various types of electrophotographic printers wherein a toner image is transferred to a fan-fold sheet such as a continuous-form recording sheet. In order to avoid wasting paper, the fan-fold sheet is first fed out of the printer to allow the last printed page to be detached from the continuous form, then the fan-fold sheet is retracted into the printed so that the next image will be printed on the subsequent blank sheet. In order to accomplish this, a pair of tractor mechanisms c and d, as shown in FIG. 6 have been employed. The mechanism c is located along the fed path, upstream from the transfer station b, while the mechanism d is located down-stream of the transfer station b.

However the use of two tractor mechanisms requires precise synchronization, which is difficult and expensive to achieve, and increases the size of the printer unit.

In order to overcome the above defects, one proposal has been to use only one tractor mechanism, with the tractor belt having one end located upstream of the transfer station and the other end downstream of the transfer station. The tractor belt thus contacts the recording sheet along the feed path and at both sides of the transfer station. However, since the tractor belt is disposed below the photoconductive drum, the pins on the belt used to mesh with the holes in the recording sheet will contact the photoconductive drum thus damaging the photoconductive coating of the drum.

Another possible modification is to employ a single tractor mechanism having a trapezoidal circulation path to guide the fan-fold sheet until the sheet enters into the transfer area and immediately after the sheet exits the transfer area, with this modification, damage to the surface of the photoconductive drum can be prevented, but other problems such as the jamming of the sheet around the transfer area and the peeling-off of a label from a substrate when a label sheet is used, may occur.

SUMMARY OF THE INVENTION

It is therefore an object of the present invention to provide an improved sheet feed mechanism to be adapted to be used in an electrophotographic printer capable of transporting a fan-fold sheet back and forth in along a straight path about a transfer area using a single tractor mechanism without damaging the photoconductive drum surface.

According to an aspect of the present invention, there is provided a sheet feed mechanism used to feed a continuous recording sheet having a plurality of equally spaced sprocket holes disposed on each side thereof, through an imaging apparatus that employs an electrophotographic transfer process. The said imaging apparatus includes a photoconductive member and a transfer device that are disposed opposite to each other. The said sheet feed mechanism feeds the sheet between the photoconductive drum and the transfer devices. The sheet feed mechanism includes a pair of feed mechanisms, with each of the feed mechanisms disposed at one side of a sheet feeding path and parallel to each other. Each of the feed mechanisms includes;

- a pair of rotating members, one of the rotating members located upstream from the transfer device, and the other of the rotating members located downsteam from the transfer device:
- a belt member looped around the rotating members, with the belt member having a plurality of equally spaced holes; and
- a plurality of engaging members, with the plurality of engaging members disposed at equal spacing around a circumferential surface of each of the rotating members, wherein the engaging members engaging the holes of said belt member and the sprocket holes of the continuous recording sheet.

According to another aspect of the present invention, there is provided a sheet feed mechanism used to feed a continuous recording sheet having a plurality of equally spaced sprocket holes disposed on each side thereof, through an imaging apparatus that employs an electrophotographic transfer process. The imaging apparatus includes a photoconductive member and a transfer device that are disposed opposite to each other, with the sheet feed mechanism feeding the sheet between the photoconductive member and the transfer device. The sheet feed mechanism includes a pair of feed mechanism with each of the feed mechanisms disposed at one side of a sheet feeding path and parallel to each other. Each of the feed mechanism includes;

- a pair of rotating members, with one of the rotating members located upstream from the transfer device, and the other of the rotating members located downstream from the transfer device;
- a belt member looped around the rotating members, with the belt member having a plurality of equally spaced engaging members, with the engaging members engaging the sprocket holes of the continuous recording sheet; and
- a regulation device for regulating a movement plane of the belt member such that the engaging members of the belt member are held out of contact with the photoconductive member.

According to a further aspect of the invention, there is provided a sheet feed mechanism wherein a continuous form sheet, having a plurality of sprocket holes spaced at a predetermined interval, formed on both side edges thereof along a direction of a straight sheet feed path, is fed between a photoconductive member and a transfer member. The sheet feed mechanism includes:

- a pair of feed rollers disposed upstream and downstream of the transfer member, respectively, in the sheet feed path, each having a plurality of engaging pins arranged on the circumferential surface thereof at the predetermined interval; and
- an endless tractor belt extending between the pair of feed rollers, with the endless belt being provided with a plurality of engaging holes in the longitudinal direction thereof at the predetermined interval for receiving the engaging pins of the pair of feed rollers therethrough,
- whereby said tractor belt is endlessly rotated upon rotation of at least one of the pair of feed rollers by means of engagement of the engaging pins and the engaging holes, and the continuous form sheet is fed straight, between the photoconductive member and the transfer member by the tractor belt by means of engagement of the engaging pins and the sprocket holes.

According to a still further aspect of the invention there is provided a sheet feed mechanism wherein a continuous form sheet having a plurality of sprocket holes spaced at a predetermined interval formed on both side edges thereof in a direction along a straight sheet feed path, is fed between a photoconductive member and a transfer member. The sheet feed mechanism includes:

a pair of feed rollers disposed upstream and downstream of the transfer member, respectively, in the sheet feed path;

an endless tractor belt extending between the pair of feed rollers, with the endless belt being provided with a plurality of engaging pins in the longitudinal direction thereof, spaced at the predetermined interval; and a regulation device for regulating an upper path portion of the tractor belt to be spaced apart from the photoconductive member.

The tractor belt is endlessly rotated upon rotation of at least one of said pair of feed rollers, and the continuous form sheet is fed straight, between the photoconductive member and the transfer member by means of engagement of the engaging pins and the sprocket holes.

DESCRIPTION OF THE ACCOMPANYING DRAWINGS

DESCRIPTION OF THE EMBODIMENTS

Figure 1:
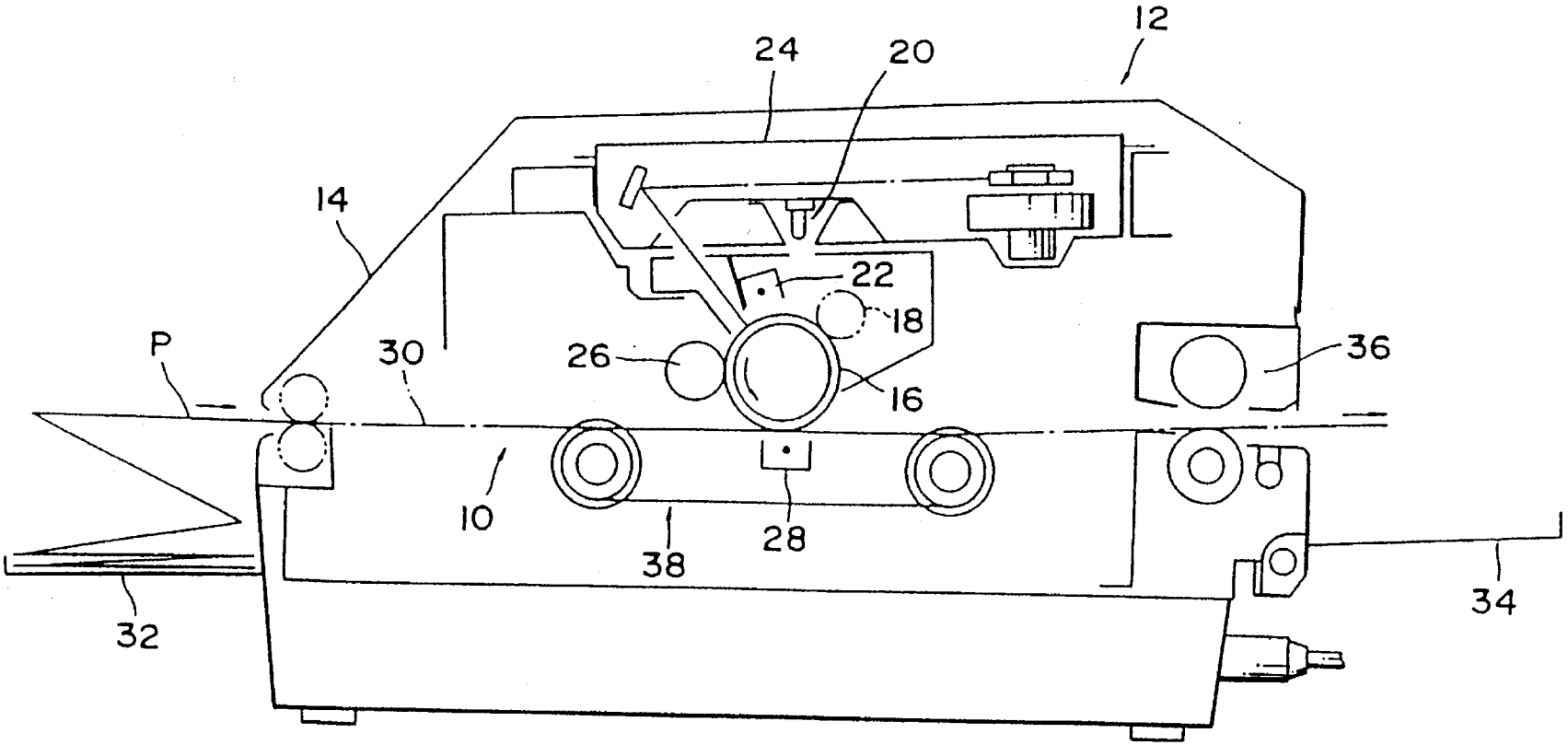
FIG. 1 is a front view showing a schematic constitution of a laser beam printer employing a sheet feed mechanism embodying the invention.
Figure 2:
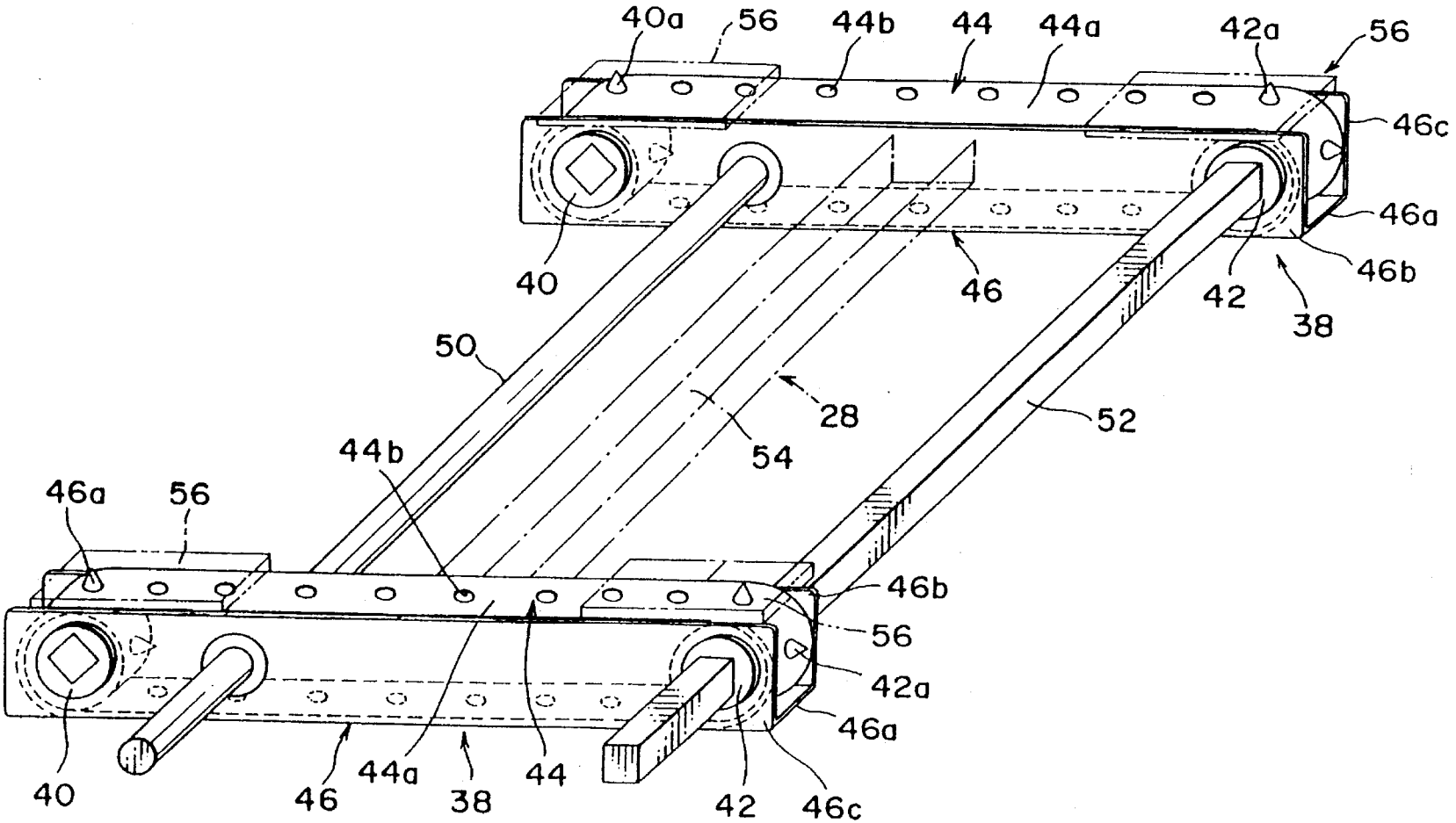
FIG. 2 is a perspective view of a tractor constituting a sheet feed mechanism.
Figure 3:
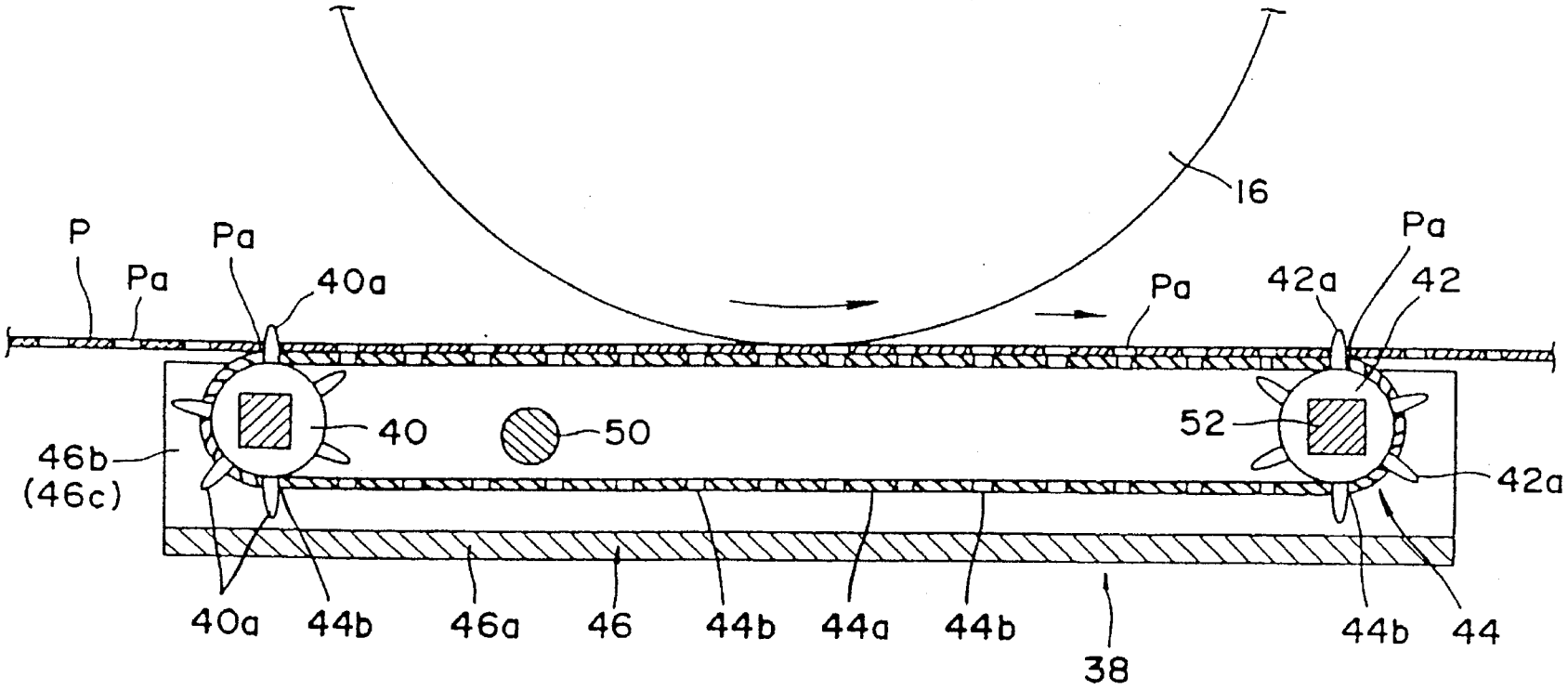
FIG. 3 is a front view of the tractor shown in FIG. 2.

FIGS. 1 through 3 show a paper feed mechanism 10 embodying the invention, which is installed in a laser beam printer 12 wherein a continuous form recording sheet is employed.

The laser beam printer 12 as shown in FIG. 1, prints an image or character information input from an external computer, or other source (both not shown), by an electrophotographic imaging method on a continuous form recording sheet P.

The laser beam printer 12 includes a body frame 14 and an electrophotographic imaging system housed therein. The electrophotographic imaging system includes a photoconductive drum 16 which is rotated at a predetermined circumferential speed by a main motor, (not shown). A toner cleaning unit 18, a discharging unit 20, a charging unit 22, a laser scanning unit 24, a developing unit 26 and a transfer charger 28, are disposed around the photoconductive drum 16.

In the illustrated embodiment, a feed path 30 of the fan-fold sheet P is defined from left to right (indicated by a broken line in FIG. 1) to pass through a transfer station. The transfer station consists of a photoconductive drum 16 and the transfer charger 28 disposed opposite to the photoconductive drum and perpendicular to the feed path. At the beginning of the feed path 30 (left side in FIG. 1), a sheet stacker 32 holding the fan-fold sheet P thereon is detachably secured to the body frame 14. At the end of the feed path 30 (right side in FIG. 1), a receiving tray 34, for P, is detachably secured to the body frame 14.

In the body frame 14, a fixing station 36, for fixing a toner image transferred onto the fan-fold sheet P as the transfer station, is provided and arranged between the transfer station and the receiving tray 34. Details of the fixing station are not illustrated in the drawing. The fixing station is constituted such that the fan-fold sheet P, carrying the unfixed toner image, is fed into a nip between a pair of heat and press rollers opposedly arranged to each other to fuse the toner image onto the fan-fold sheet P by means of pressure and heat.

The feed path 30 is formed to be straight at least at the transfer station area, (i.e., the fan-fold sheet P is to be fed straight while passing through the transfer station). As illustrated in detail in FIG. 2, a pair of tractor mechanisms 38, connected to be synchronously driven with each other, are disposed, respectively, at each axial end of the photoconductive drum 16. The transfer charger 28 is placed between the pair of tractor mechanisms.

Each tractor mechanism 38 includes one feed roller 40 arranged upstream of the transfer station along the feed path of the fan-fold sheet P, another feed roller 42 arranged downstream of the transfer station and an endless tractor belt 44 extended between the feed rollers 40 and 42. Each tractor belt 44 includes a belt member **44*a* and a series of sprocket holes 44*b* formed in the belt member 44*a* at the same intervals as sprocket holes Pa (see FIG. 3) formed in respective side edges of the fan-fold sheet P, in its longitudinal direction. The belt member 44*a*** is made of a resilient material.

Each feed roller 40, 42 is provided with a series of engaging pins **40*a*, 42*a* on the circumferential surface arranged at the same intervals as the sprocket holes 44*b* of the belt member 44*a* (i.e., at same intervals as the sprocket holes Pa of the fan-fold sheet P). The engaging pins 40*a*, 42*a* engage the sprocket holes 44*b* of the tractor belt 44 to drive the tractor belt 44 in the sheet feed direction upon rotation of the feed roller 40, 42**.

The feed roller 40 disposed upstream in the feed path 30 of the fan-fold sheet P is constituted to be driven by a driving motor (not shown). The engaging pins **40*a* of the fed roller 40 are engaged with the sprocket holes 44*b* of the tractor belt 44, so that the tractor belt 44 is driven upon rotation of the feed roller 40 in such a fashion that the upper part of the tractor belt 44** is continuously run in the sheet feed direction.

The feed rollers 40, 42 are disposed at such positions that the fan-fold sheet P carried by the tractor belt 44, extended between the rollers 40, 42, slightly contacts the bottom portion of the circumferential surface of the photoconductive drum 16. The fan-fold sheet P is transported by the rotation of the feed rollers 40, 42 by means of the engagement of the engaging pins **40*a*, 42*a* of the feed rollers 40, 42, upwardly protruding through the engaging holes 44*b* of the tractor belt 44** and the sprocket holes Pa of the fan-fold sheet P.

A pair of guide members 46, each having a U-shaped sectional configuration and extending along the sheet feed path, are arranged in parallel to each other with a predetermined spacing therebetween in the axial direction of the photoconductive drum 16. Each guide member 48 includes a bottom plate portion **46*a* and a pair of inner and outer wall portions 46*b*, 46*c* upwardly extending from the bottom plate portion 46*a***.

The above-mentioned pair of the feed rollers 40, 42 are rotatably supported by the guide member 46 at upstream and downstream end portions thereof, respectively. The pair of guide members 46 are connected to each other by a connecting rod 50, and the pair of the feed rollers 40 supported by respective guide members 46 are connected by a transmission rod 52 having a square sectional configuration. The transmission rod 52 is rotated by driving force from a main motor (not shown), and thereby the pair of feed rollers 40, 42 are synchronously rotated.

The transfer charger 28 includes (indicated by a dash and dotted line), a charger housing 54 extending in the axial direction of the photoconductive drum 16, both ends of which are fixed to the inner wall portions **46*b* of the guide members 46, respectively. Sheet press members 56 are disposed (illustrated in FIG. 2 by a dash and double-dotted line), above the upstream and downstream end portions of the respective tractor belts 44, so as to keep the fan-fold sheet P stably engaged with the engaging pins 40*a*, 42*a* of the feeding rollers 40, 42**.

With the above constituted laser beam printer, a laser beam emitted from the laser scanning unit 24 scans (exposes) the circumferential surface of the photoconductive drum 16 in an axial direction of the drum 16 (i.e., a main scanning direction), while the drum 16 is rotated in the circumferential direction as indicated by an arrow in FIG. 1 (i.e., an auxiliary scanning direction) to form a latent image on the surface of the drum 16. The latent image on the surface of the drum 16 is then developed by the developing unit 26 to form a toner image. This developed toner image is transferred by the transfer charger 28 to the fan-fold sheet P being fed along the sheet feed path 30 and fixed by the fixing device 36. The fan-fold sheet P, carrying the fixed toner image, is then fed out of the body frame 14 to be stacked on the sheet receiving tray 34.

As explained above, in the laser beam printer embodying the invention, the tractor 38 is constituted such that the engaging pins **40*a*, 42*a* engage the fan-fold sheet P at a location on the sheet that is out of contact with photoconductive drum 16. However the recording sheet is fed past the photoconductive drum 16** in such a manner that the sheet P firmly contacts the drum, since the resilient nature of the tractor belt results in pressure being applied to the recording sheet as it passes below the photoconductive drum.

Further, since the tractor belt 44 is constructed from a resilient material and the belt is essentially smooth and flat, the tractor belt 44 will not damage the photoconductive drum 16.

Figure 6:
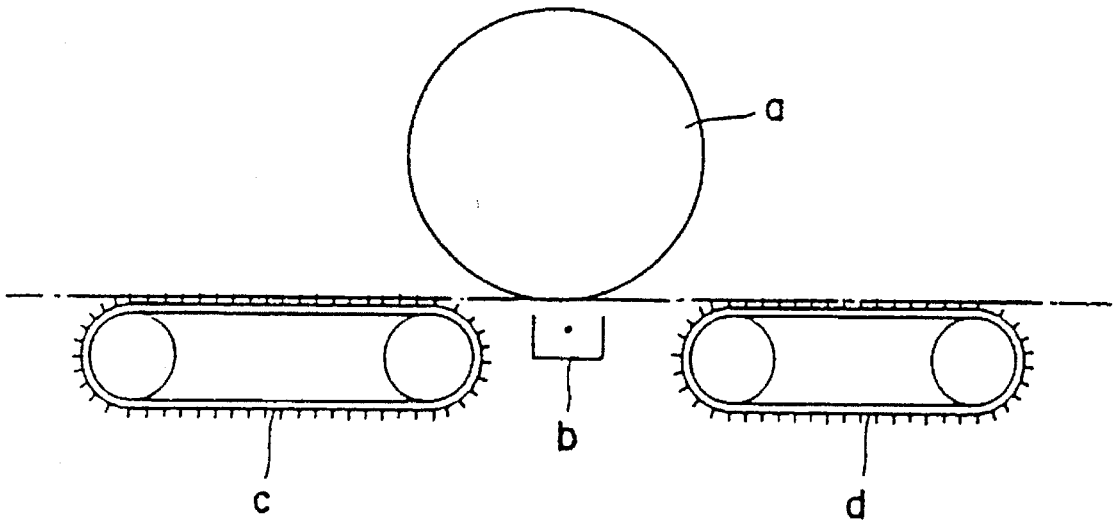
FIG. 6 shows a conventional sheet feed mechanism.

Also, according to the above embodiment, as the fan-fold sheet P can be transported back and forth by one tractor 38, the probability of loosening and/or breaking the fan-fold sheet P during transportation is greatly reduced when compared with the conventional printer shown in FIG. 6.

According to the above embodiment, the engaging pins of the tractor 38 do not contact the circumferential surface of the photoconductive drum 16.

The tractors 38, 38 may be manually moved or moved by a motor or some other driving force.

Furthermore, according to the above embodiment, the sheet feed path 30 remains planar around the transfer station, therefore jamming of the fan-fold sheet P can be prevented, and the peeling-off of a label from a substrate when a label sheet is used can also be prevented.

Both axial ends of the charger housing 54 are secured to the guide members 46 in the above embodiment, but the charger housing 54 may be formed independently of the guide members as discussed below with respect to FIG. 7.

Figure 4:
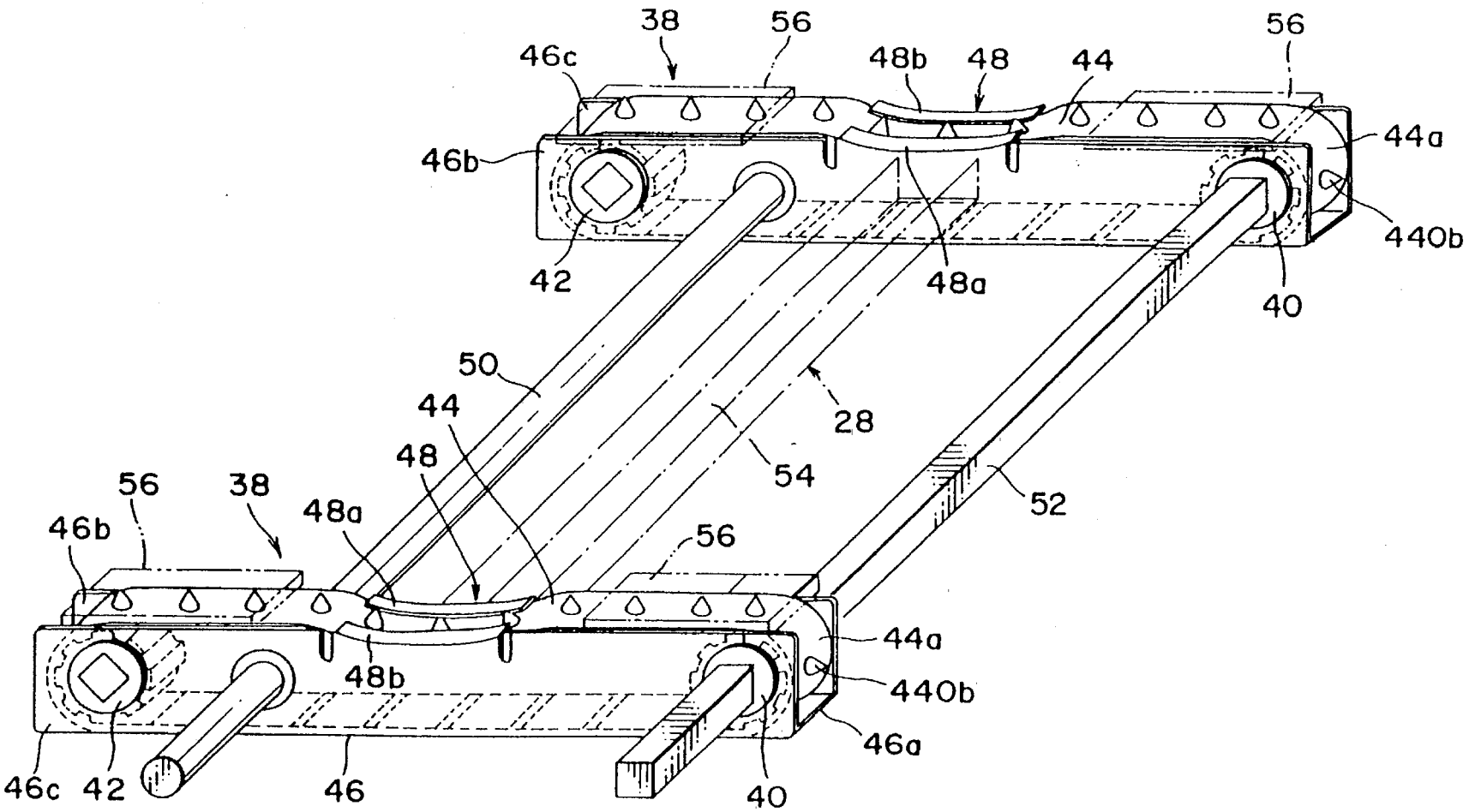
FIG. 4 is a perspective view of a modified tractor constituting a sheet feed mechanism.
Figure 5:
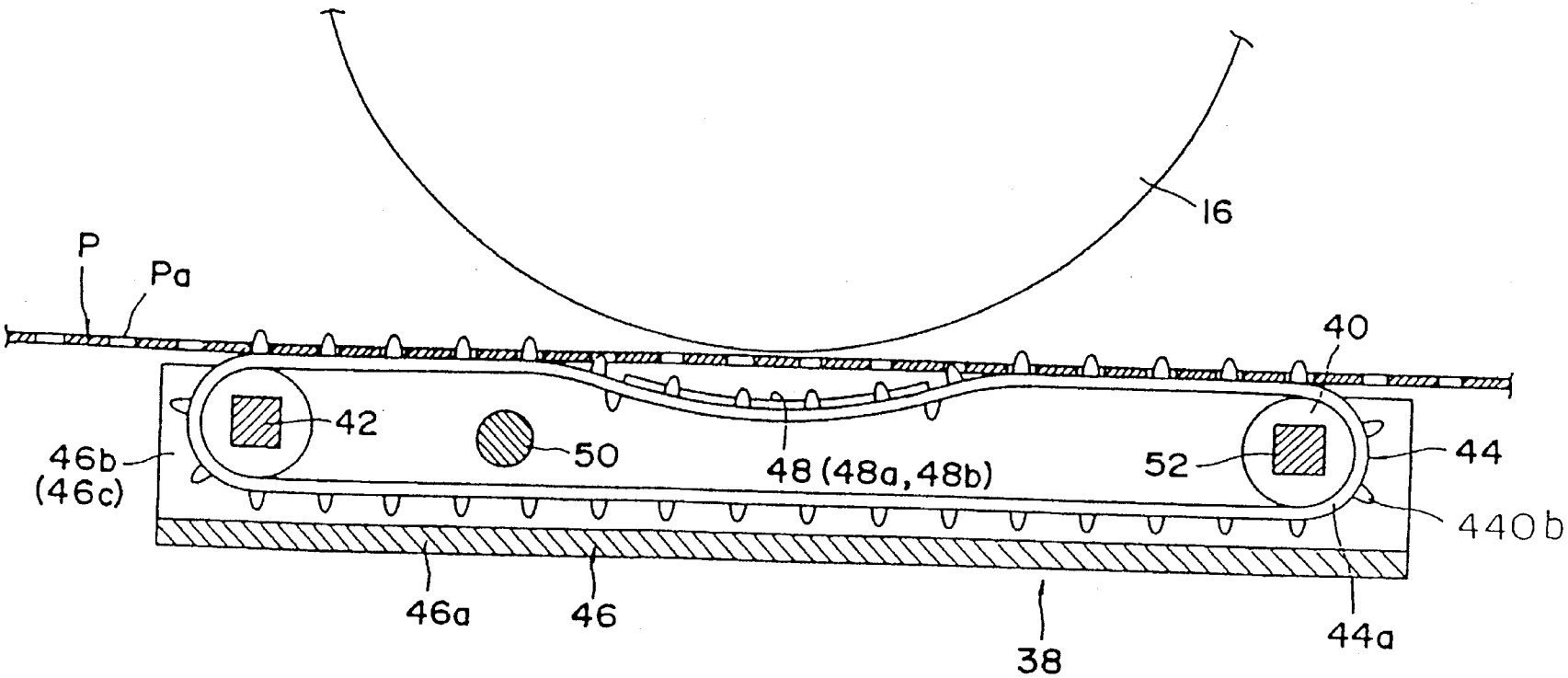
FIG. 5 is a front view of the tractor shown in FIG. 4.

FIGS. 4 and 5 illustrate a modified embodiment of the invention.

In this modified embodiment, a plurality of engaging pins **440*b* are provided on the belt member 44*a* of the tractor belt 44 instead of the holes 44*b* formed on the belt member 44 and the engaging pins 40*a*. 42*a* provided on the feed rollers 40, 42** in the previous embodiment.

Further, each guide member 46 is formed with a curved portion 48 at the upper portion thereof which is positioned just below the photoconductive drum 16. The curved portion 48 has a downwardly curved arc-shape that is concentric with the circumferential surface of the drum 16. More particularly, the curved portion 48 includes a curved inwardly-bent-portion **48*a* formed on the upper edge of the inner wall 46*b* and a curved inwardly-bent-portion 48*b* formed on the upper edge of the outer wall 46*c***.

The belt member **44*a* of the tractor belt 44 is fed below the bent-portions 48*a* and 48*b* to be guided away from the drum 16 when the belt member 44*a* is below the photoconductive drum 16. The curvature of the bent-portions 48*a*, 48*b* is such that the belt member 44*a* is transported long the circumferential surface of the drum 16 with a spacing therebetween which is larger than the distance that the engaging pins 440*b* protrude out of the belt member 44*a***.

The bent-portions **48*a*, 48*b* are formed to be spaced apart from each other such that the engaging pins 440*b* of the tractor belt 44** can pass between them.

With the above constituted modified embodiment, even though the belt member 44 with the engaging pins **440*b* passes through the transfer area, as the belt member 44 is fed below the photoconductive drum 16 by the bent-portions 48*a*, 48*b*, the engaging pins 44*b* do not contact the circumferential surface of the drum 16**, and therefore the photoconductive surface will not be damaged.

Although, in the above second embodiment, the bent-portions **48*a*, 48*b* are integrally formed on the guide members 46 of the tractor 38**, they may be formed as separate members and/or supported by other parts such as the body frame and the drum support frame.

Figure 7:
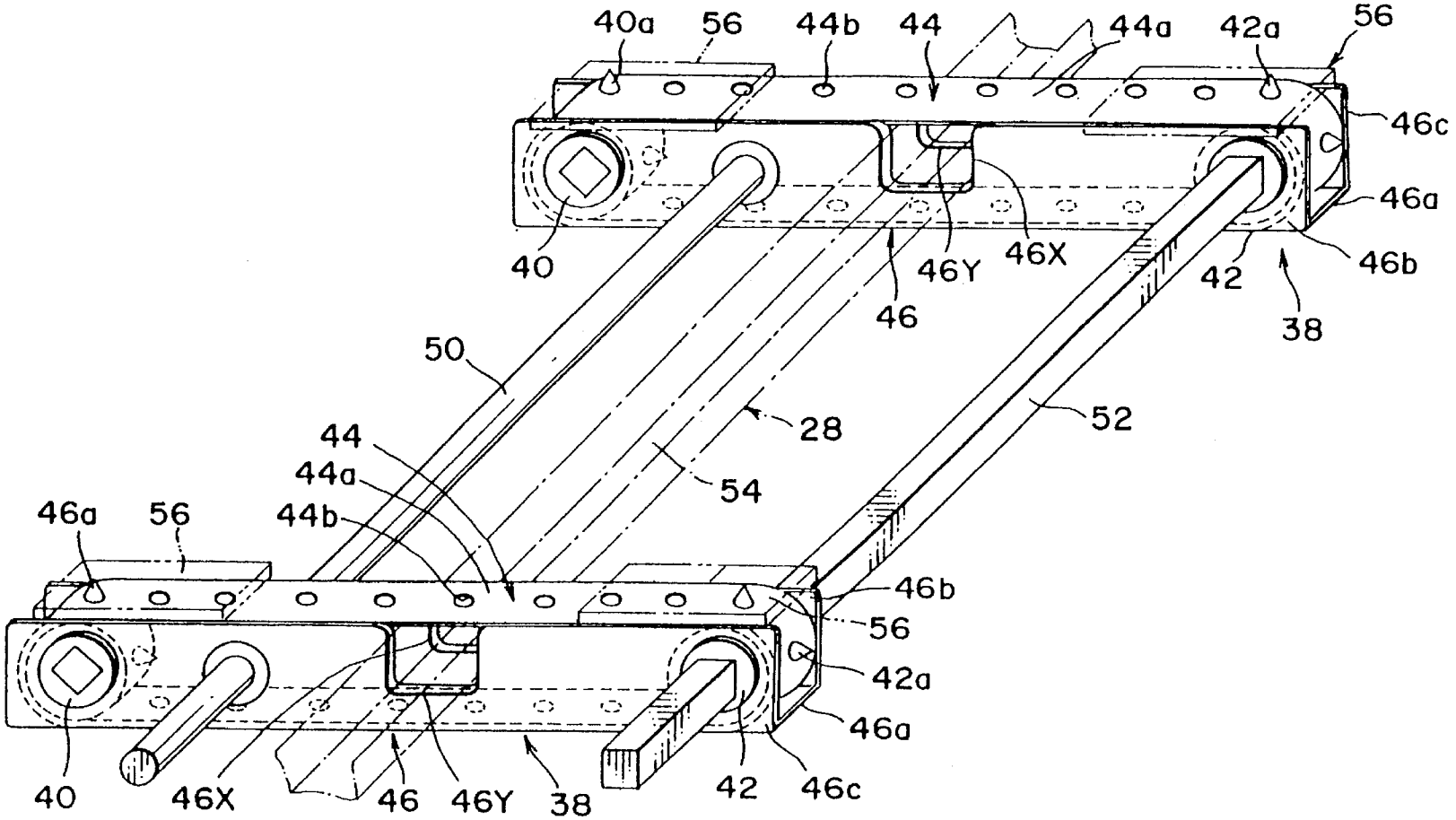
FIG. 7 is a perspective view of another modified tractor constituting an adjustable sheet feed mechanism.

FIG. 7 illustrates another modified embodiment of the invention. In this embodiment, the spacing between the pair of tractors can be freely adjusted (i.e., any type of the fan-fold sheet P having different width sizes may be used). Thus by sliding the tractors 38, 38 along the shafts 50 and 52, the width between the tractors 38, 38 will change. Therefore, different paper sizes (A4, B4, B5, Letter etc.) having different paper widths, may be easily accommodated.

Cut-out portions 46X and 46Y are formed in respective side walls **46*b*, 46*c* of each guide member 46. Charger housing 54 extends in the axial direction of photoconductive drum 16 through respective cut-out portions 46X, 46Y. Charger housing 54 may be supported by the chassis (not shown) or other stationary parts of the printer. Accordingly, guide members 46 are slidable along shafts 50 and 52 with respect to charger housing 54** to change the spacing between the pair of tractors.

The invention is not limited to the embodiments as described above but other embodiments and modifications may be applied without departing from the spirit thereof.

The present enclosure relates to subject matter contained in Japanese Patent Application No. HEI 4 -93808 filed on Dec. 29, 1992 and HEI 4-93809 filed on Dec. 29, 1992, and incorporated in their entireties by their reference herein.

What is claimed is:

1. A sheet feed mechanism used to feed a continuous recording sheet, having a plurality of equally spaced sprocket holes disposed on each side thereof, through an imaging apparatus that employs an electrophotographic transfer process, said imaging apparatus comprising a photoconductive member and a transfer means that are disposed opposite to each other, said sheet feed mechanism feeding said continuous recording sheet between said photoconductive member and said transfer means, said sheet feed mechanism comprising a pair of feed means, each of said feed means disposed at one side of a sheet feeding path and parallel to each other, each of said feed means comprises;

a pair of rotating members, one of said rotating members located upstream from said transfer means, and the other of said rotating means located downstream from said transfer means;

a belt member looped around said rotating members, said belt member having a plurality of equally spaced holes; and a plurality of engaging members, said plurality of engaging members disposed at equal spacing around a circumferential surface of each of said rotating members, said engaging members engaging said holes of said belt member and said sprocket holes of said continuous recording sheet.

2. The sheet feed mechanism of claim 1 wherein an axial member connects one of said rotating members of one of said feed means to an oppositely disposed rotating member of another of said feed means.

3. The sheet feed mechanism of claim 1 wherein said engaging members are integrally formed on said rotating members.

4. The sheet feed mechanism of claim 2 wherein a distance between each of said pair of feed means can be changed by sliding at least one of said feed means along said axial member towards said other of said feed means.

5. A sheet feed mechanism used to feed a continuous recording sheet, having a plurality of equally spaced sprocket holes disposed on each side thereof, through an imaging apparatus that employs an electrophotographic transfer process, said imaging apparatus comprising a photoconductive member and a transfer means that are disposed opposite to each other, said sheet feed mechanism feeding said continuous recording sheet along a feed plane between said photoconductive member and said transfer means, said sheet feed mechanism comprising a pair of feed means, each of said feed means disposed at one side of a sheet feeding path and parallel to each other, each of said feed means comprises:

a pair of rotating members, one of said rotating member located upstream from said transfer means, and the other of said rotating members located downstream from said transfer means;

a belt member looped around said rotating members, said belt member having a plurality of equally spaced engaging members, said engaging members engaging said sprocket holes of said continuous recording sheet;

said engaging members facing and being exposed to said photoconductive member; and regulation means for regulating a movement path of said belt member such that said engaging members of said belt member are held out of contact with said photoconductive member.

6. The sheet feed mechanism of claim 5 wherein an axial member connects one of said rotating members of one of said feed means to an oppositely disposed rotating member of another of said feed means.

7. The sheet feed mechanism of claim 5 wherein said engaging members are integrally formed on said belt member.

8. A sheet feed mechanism wherein a continuous form sheet having a plurality of sprocket holes spaced at a predetermined interval, formed on both side edges thereof along a direction of a straight sheet feed path, is fed between a photoconductive member and a transfer member, said sheet feed mechanism comprises:

a pair of feed rollers disposed upstream and downstream of said transfer member, respectively, in said sheet feed path, each having a plurality of engaging pins arranged on a circumferential surface thereof a at said predetermined interval; and an endless tractor belt extending between said pair of feed rollers, said endless belt being provided with a plurality of engaging holes in the longitudinal direction thereof at said predetermined interval for receiving said engaging pins of said pair of feed rollers therethrough, whereby said tractor belt is endlessly rotated upon rotation of at least one of said pair of feed rollers by means of engagement of said engaging pins and said engaging holes, and said continuous form sheet is fed straight, between said photoconductive member and said transfer member by said tractor belt by means of engagement of said engaging pins and said sprocket holes.

9. The sheet feed mechanism according to claim 8, wherein said photoconductive member is a photoconductive drum, and said continuous form sheet is fed straight through said photoconductive drum and said transfer member while abutting said circumferential surface of said drum.

10. A sheet feeding mechanism wherein a continuous form sheet, having a plurality of sprocket holes spaced at a predetermined interval formed on both side edges thereof in a direction along a straight feed path is fed between a photoconductive member and a transfer member, said sheet feed mechanism comprising:

first and second feed rollers disposed upstream and downstream of said transfer member, respectively, in said feed path;

an endless tractor belt extending between said first and second feed rollers, said tractor belt being provided with a plurality of engaging pins in a longitudinal direction thereof, spaced at said predetermined interval;

said engaging pins facing and being exposed to said photoconductive member; and a regulation means for regulating an upper path portion of said tractor belt to be spaced apart from said photoconductive member;

whereby said tractor belt is endlessly rotated upon rotation of at lest one of said pair of feed rollers, and said continuous form sheet is fed straight, between said photoconductive member and said transfer member by means of engagement of said engagement pins and said sprocket holes.

11. The sheet feed mechanism according to claim 10, wherein said photoconductive member is a photoconductive drum, and said continuous form sheet is fed straight between said photoconductive drum and said transfer member while abutting a circumferential surface of said photoconductive drum.

12. The sheet feed mechanism according to claim 11, wherein said regulating means comprises a regulating member which causes said tractor belt to be spaced apart from a circumferential surface of said photoconductive drum by an amount larger than a length that said engaging pins protrude out of said tractor belt.

13. Apparatus according to claim 5, wherein said regulation means disengages said engaging members from said sprocket holes.

14. Apparatus according to claim 5, wherein said regulation means disengages said engaging member from said sprocket holes upstream from said photoconductive member.

15. Apparatus according to claim 5, wherein said regulation means reengages said engaging members with said sprocket holes.

16. Apparatus according to claim 5, wherein said regulation means reengages said engaging members with said sprocket holes downstream from said photoconductive member.

17. Apparatus according to claim 5, wherein said regulation means includes a guide member with diverges said movement path from said feed plane at a point upstream from said photoconductive drum.

18. Apparatus according to claim 17, wherein said guide member moves said belt member along a curvature of said photoconductive drum at a distance from said photoconductive drum which is larger than a size of said engaging members.

19. Apparatus according to claim 18, wherein said guide member realigns said movement path with said plane at a point downstream from said photoconductive drum.

20. Apparatus according to claim 9, wherein said regulation means disengages said engaging pins from said sprocket holes.

21. Apparatus according to claim 10, wherein said regulation means disengages said engaging pins from said sprocket holes upstream from said photoconductive member.

22. Apparatus according to claim 10, wherein said regulation means reengages said engaging pins with said sprocket holes.

23. Apparatus according to claim 10, wherein said regulation means reengages said engaging pins from said sprocket holes downstream from said photoconductive member.

24. Apparatus according to claim 12, wherein said regulating member diverts said tractor belt from said straight feed path at a point upstream from said photoconductive member.

25. Apparatus according to claim 21, wherein said regulating member moves said tractor belt along a curvature of said photoconductive drum at a distance from said photoconductive drum which is larger than a size of said engaging pins.

26. Apparatus according to claim 24, wherein said regulation member realigns said tractor belt with said straight feed path at a point downstream from said photoconductive drum.

27. An image apparatus which transfers an image onto a continuous recording sheet having a plurality of equally spaced sprocket holes, comprising:

a photoconductive member;

a transfer means disposed opposite said photoconductive member;

first and second feeders feeding said continuous recording sheet along a sheet feeding path, said sheet feeding path passing between said photoconductive member and said transfer means;

said first and second sheet feeders being disposed parallel to each other and on opposite sides of the sheet feeding path, each of said first and second sheet feeders including:

a first rotating member disposed upstream from said transfer means, and a second rotating member disposed downstream from said transfer means;

a belt member, looped around said first and second rotating members;

said belt member having a plurality of equally spaced engaging members, said engaging members engaging said sprocket holes of said continuous recording sheet; and a guide member having a diverting area disposed in said sheet feeding path and between said photoconductive member and said transfer means, said diverting area moving said belt member out of contact with said photoconductive member.

28. An image apparatus with transfers and image onto a continuous recording sheet having a plurality of equally spaced sprocket holes, comprising:

a photoconductive member;

a transfer means disposed opposite said photoconductive member;

fist and second feeders feeding said continuous recording sheet along a sheet feeding path, said sheet feeding path passing between said photoconductive member and said transfer means;

said first and second sheet feeders being disposed parallel to each other and on opposite sides of the sheet feeding path, each of said first and second sheet feeders including:

a first rotating member disposed upstream from said transfer means, and a second rotating member disposed downstream from said transfer means;

a belt member, looped around said first and second rotating members;

said belt member having a plurality of equally spaced engaging members, said engaging members engaging said sprocket holes of said continuous recording sheet; and a guide member, disposed between said photoconductive member and said transfer means, which disengages said engaging members from said sprocket holes.

29. Apparatus according to claim 22, wherein said guide member reengages said engaging members with said sprocket holes.

30. Apparatus according to claim 22, wherein said guide member has an arcuate shape.

* * * * *

UNITED STATES PATENT AND TRADEMARK OFFICE

CERTIFICATE OF CORRECTION

PATENT NO. : 5,515,149

DATED : May 7, 1996

INVENTOR(S) : Y. ISHIKAWA et al.

It is certified that error appears in the above-indentified patent and that said Letters Patent is hereby corrected as shown below:

On the Title page, itm [54], and col. 1, line 1, change "SPEED" to --SPACED--.

At column 8, line 10 (claim 8, line 10), delete "a" (second occurrence).

At column 9, line 13 (claim 17, line 2), change "with" to ---which---.

At column 9, line 24 (claim 20, line 1), change "9," to ---10,---.

At column 9, line 42 (claim 25, line 1), change "21," to ---24,---.

Signed and Sealed this

Eleventh Day of February, 1997

Bruce Lehman

*Attest:*

BRUCE LEHMAN

*Attesting Officer*

*Commissioner of Patents and Trademarks*